US009377032B2

(12) United States Patent
Fuegel

(10) Patent No.: US 9,377,032 B2
(45) Date of Patent: Jun. 28, 2016

(54) MOBILE CONCRETE PUMP

(71) Applicant: Putzmeister Engineering GmbH, Aichtal (DE)

(72) Inventor: Dietmar Fuegel, Wolfschlugen (DE)

(73) Assignee: Putzmeister Engineering GmbH, Aichtal (DE)

( * ) Notice: Subject to any disclaimer, the term of this patent is extended or adjusted under 35 U.S.C. 154(b) by 0 days.

(21) Appl. No.: 14/416,122

(22) PCT Filed: May 31, 2013

(86) PCT No.: PCT/EP2013/061279

§ 371 (c)(1),
(2) Date: Jan. 21, 2015

(87) PCT Pub. No.: WO2014/029517

PCT Pub. Date: Feb. 27, 2014

(65) Prior Publication Data

US 2015/0176608 A1 Jun. 25, 2015

(30) Foreign Application Priority Data

Aug. 24, 2012 (DE) ..... 10 2012 215 049

(51) Int. Cl.
*F15B 1/26* (2006.01)
*E04G 21/04* (2006.01)
*B66C 23/80* (2006.01)

(52) U.S. Cl.
CPC . *F15B 1/26* (2013.01); *B66C 23/80* (2013.01); *E04G 21/04* (2013.01)

(58) Field of Classification Search
CPC ..... F15B 1/26; B66C 23/80; E04G 21/04
USPC ..... 280/763.1, 830; 417/234, 572, 900
See application file for complete search history.

(56) References Cited

U.S. PATENT DOCUMENTS 4,299,530 A 11/1981 Schaeff
6,276,718 B1 * 8/2001 Wolfram et al. ..... 280/765.1

(Continued)

FOREIGN PATENT DOCUMENTS

CN 201953077 U 8/2011
DE 28 54 526 A1 6/1980

(Continued)

OTHER PUBLICATIONS

International Preliminary Report on Patentability in PCT/EP2013/061279, mailing date Feb. 26, 2015.

(Continued)

*Primary Examiner* — Jacob Knutson
(74) *Attorney, Agent, or Firm* — Collard & Roe, P.C.

(57) ABSTRACT

A mobile concrete pump includes a supporting structure that can be placed directly or indirectly via an assembly frame on the running gear of an HGV chassis, for receiving functional units that form a support device and a placing boom. The placing boom is rotatably mounted on a boom pedestal that is integrated into the supporting structure, while the support device includes two telescopic tubes which are integrated into the supporting structure, cross over one another at different heights and have diagonal passages that are open at the front. A respective open space in the supporting structure lies below the upper and above the lower telescopic tube, each open space being separated from the neighboring telescopic tube by an intermediate base. A pre-fabricated liquid tank is inserted into at least one of the open spaces, the outer contour of the tank being geometrically adapted to the supporting structure and the tank supplementing and reinforcing the supporting structure.

6 Claims, 4 Drawing Sheets

(56) References Cited

U.S. PATENT DOCUMENTS

Figure 1:
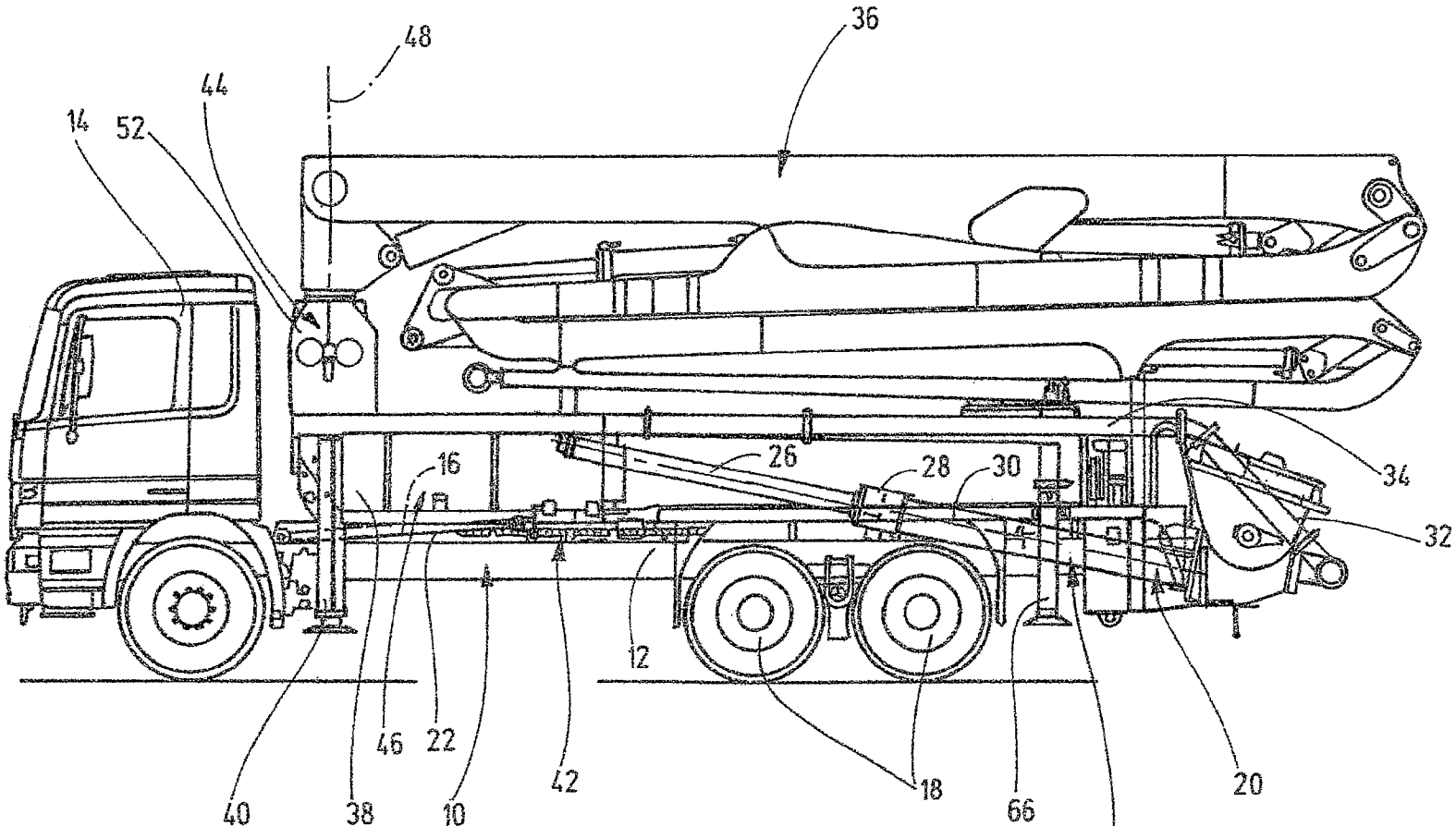

| | | | | |
|---|---|---|---|---|
| 6,390,504 | B1 * | 5/2002 | Fetzer | 280/763.1 |
| 6,840,540 | B2 * | 1/2005 | Fugel | 280/763.1 |
| 7,654,800 | B2 | 2/2010 | Leibbrand et al. | |
| 8,794,670 | B2 * | 8/2014 | Fuegel | 280/763.1 |
| 2005/0271522 | A1 * | 12/2005 | Leibbrand et al. | 417/234 |
| 2007/0277881 | A1 * | 12/2007 | Fugel | 137/351 |

FOREIGN PATENT DOCUMENTS

| | | | |
|---|---|---|---|
| DE | 44 14 567 | A1 | 11/1995 |
| DE | 102 46 447 | A1 | 4/2004 |
| EP | 1 847 505 | A2 | 10/2007 |
| JP | H11 335076 | A | 12/1999 |
| WO | WO 2012065795 | A1 * | 5/2012 |

OTHER PUBLICATIONS

International Search Report of PCT/EP2013/061279, mailed Aug. 29, 2013.

German Search Report in DE 10 2012 215 049.8, dated May 8, 2013, with English translation of relevant parts.

* cited by examiner

MOBILE CONCRETE PUMP

CROSS REFERENCE TO RELATED APPLICATIONS

This application is the National Stage of PCT/EP2013/061279 filed on May 31, 2013, which claims priority under 35 U.S.C. §119 of German Application No. 10 2012 215 049.8 filed on Aug. 24, 2012, the disclosure of which is incorporated by reference. The international application under PCT article 21(2) was not published in English.

The invention relates to a mobile concrete pump with a carrying structure which is capable of being placed directly or indirectly via a mounting frame onto a running gear of a truck chassis and is preferably in the form of a welded structure, for the accommodation of functional units forming a supporting device and a distributor mast, wherein the distributor mast is mounted rotatably on a mast trestle integrated in the carrying structure, and the supporting device comprises two telescopic tubes which are integrated in the carrying structure, are open diagonally forward and intersect each other at different heights, and wherein, below the upper and above the lower telescopic tube, the carrying structure has a respective clearance which is separated from the adjacent telescopic tube by an intermediate floor.

In the case of mobile concrete pumps of this type (DE 102 46 447 A1), the carrying structure is mounted onto a mounting frame and is placed together therewith onto the running gear of a truck chassis. The mounting frame additionally comprises a drive assembly for activating the functional units and the core pump. Depending on the pump model, the drive assembly comprises one or more hydraulic pumps and further auxiliary pumps, for example for driving a stirrer in the material feed container of the core pump. For the supply of the hydraulic units of the drive assembly and of the functional units, a tank of appropriate size is required for the hydraulic oil. Since the construction space on a modern automatic concrete pump is limited, it is appropriate to configure parts of the carrying structure that are present in any case as a tank.

However, it should be taken into consideration here that hydraulic tanks have to be subjected to a reliable leak test. In the leak test, the volume serving as the tank is pressurized and investigated for leakages. The tank can be used according to the specification only if there are no leakages. Secondly, it should be taken into consideration that the carrying structure containing the mast trestle is a very large and heavy welded structure which is handlable only with great complexity, for example, in order to carry out a leak test. Any leakages occurring during such a test can be sealed only with difficulty if the joining points are located in the interior of the mast trestle.

Taking this as the starting point, the object on which the invention is based is to improve a mobile concrete pump with a carrying structure of the type indicated at the beginning to the effect that a liquid tank which is easily handlable for a leak test can be integrated there.

To achieve this object, the feature combination indicated in patent claim 1 is proposed. Advantageous refinements and developments of the invention are apparent from the dependent claims.

The solution according to the invention essentially consists in that a premanufactured liquid tank which is adapted geometrically in the outer contour thereof to the carrying structure and supplements and reinforces the carrying structure is fitted, preferably welded, into at least one of the clearances of the carrying structure. The effect achieved with these measures is that the outer walls of the liquid tank are designed at the same time as load-bearing walls within the carrying structure. The handling of the liquid tank when carrying out a leak test is relatively simple because the liquid tank has significantly smaller dimensions, owing to the premanufacturing, in comparison to the entire carrying structure. Repair of leakages can also be easily carried out because of the easy accessibility of the liquid tank within the carrying structure. Since parts of the liquid tank with the load-bearing walls thereof are used for the carrying structure, the advantages of an integral tank are virtually maintained, with the exception of double floor or ceiling plates.

According to a further advantageous refinement of the invention, the premanufactured liquid tank can comprise an integral side wall section and an integral floor, rear wall and ceiling section welded thereto. In this case, both the side wall section and the floor, rear wall and ceiling section can be designed as bent sheet-metal parts which are easily producible. The side wall section advantageously has at least one opening which is intended for the attaching of a connecting pipe, a coupling sleeve and/or a window. The tank can thereby be filled or emptied from the outside, and said tank can communicate with the hydraulic functional units via connecting lines.

In order to ensure secure fixing of the liquid tank in the carrying structure, it is proposed, according to a further advantageous refinement of the invention, that the carrying structure has a ceiling plate which bounds the clearance and is arranged at a distance from the intermediate floor, and that the liquid tank can be welded to the adjacent telescopic tube, the ceiling plate and optionally to a rear wall.

Figure 2:
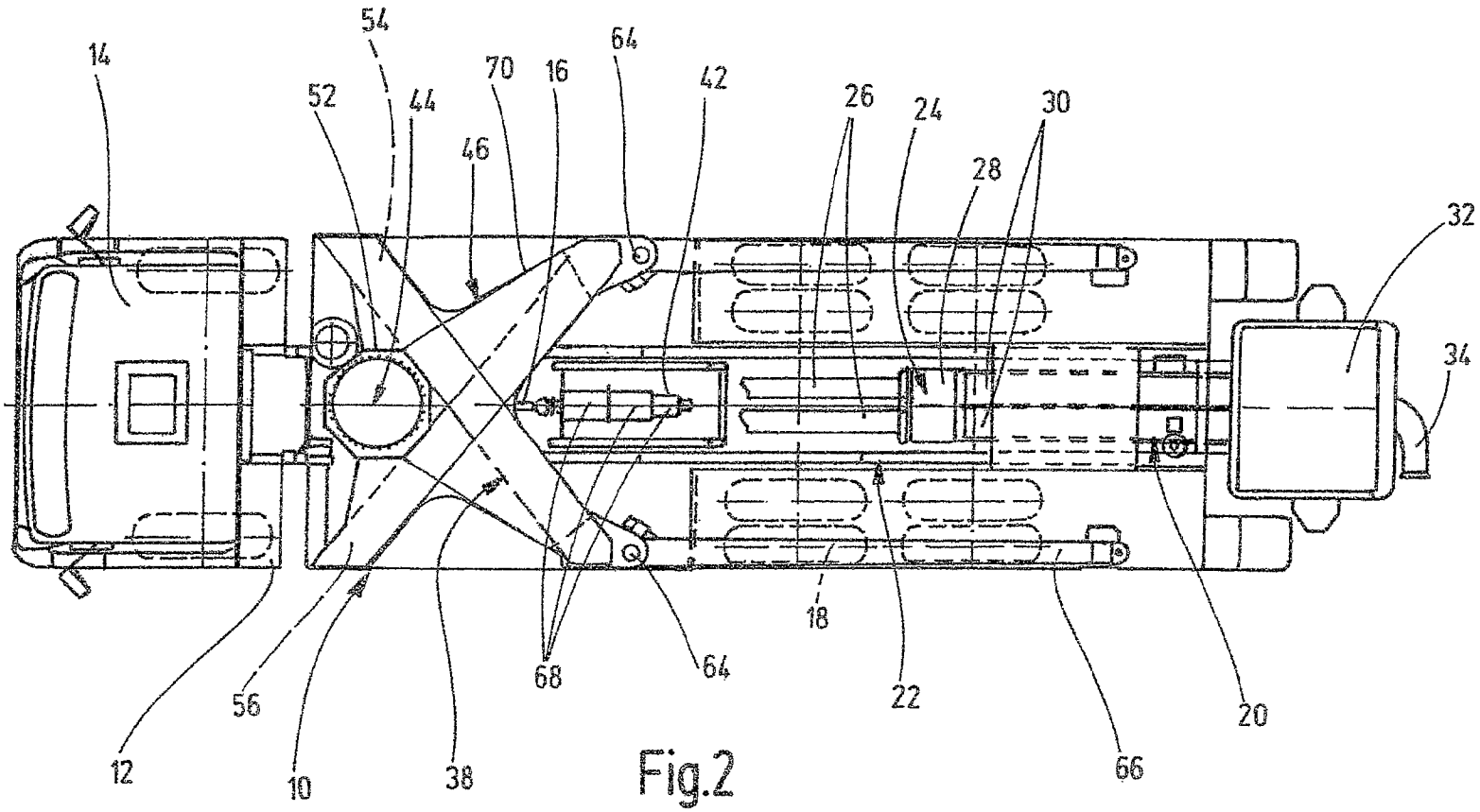
Figure 3A:
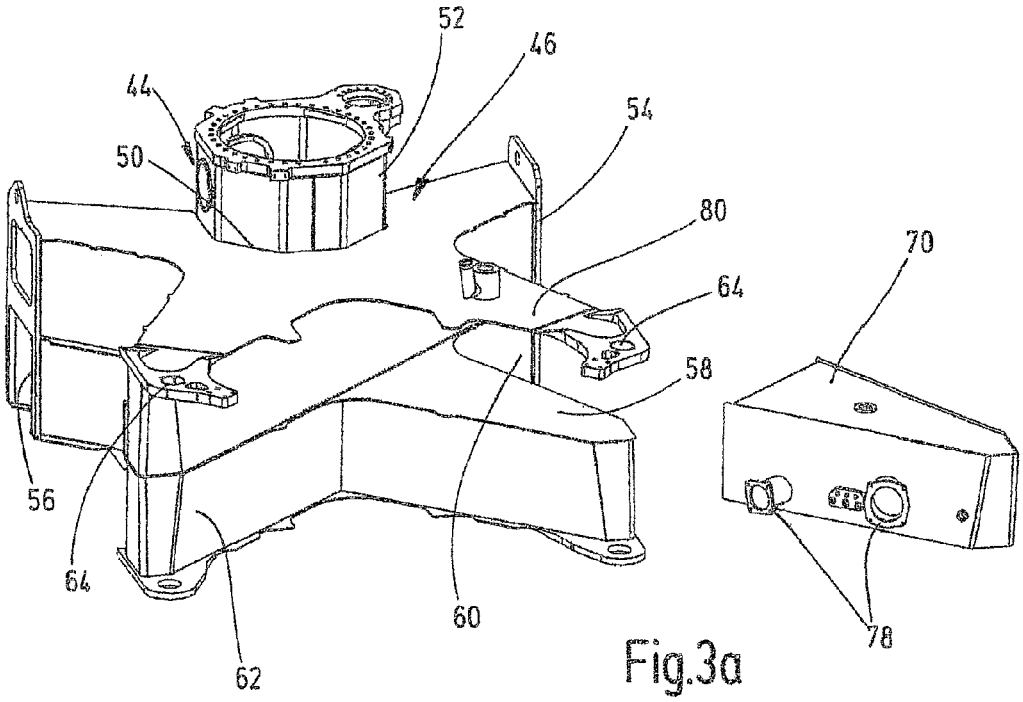
Figure 3B:
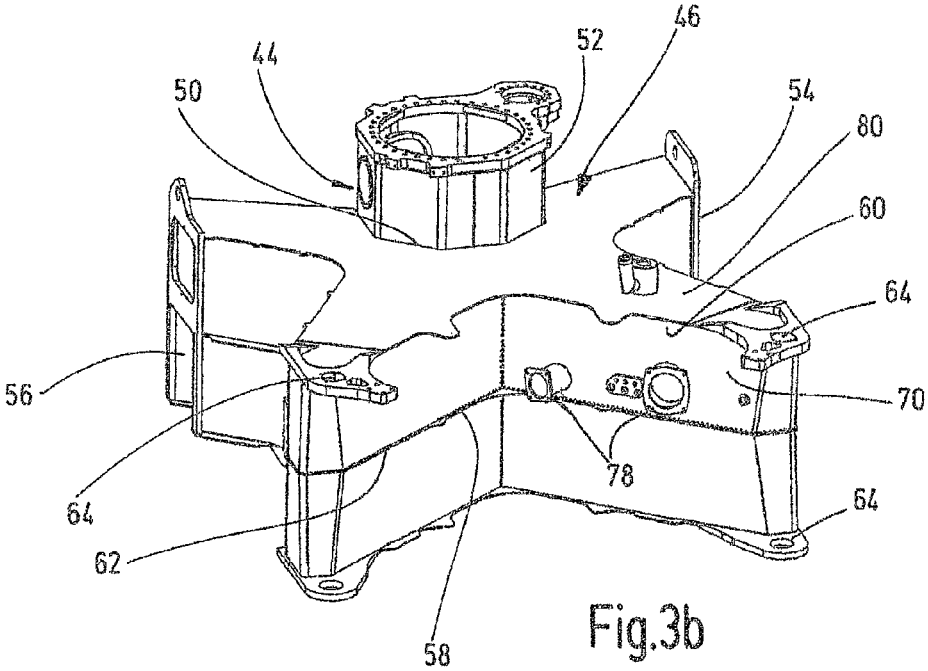
Figure 4A:
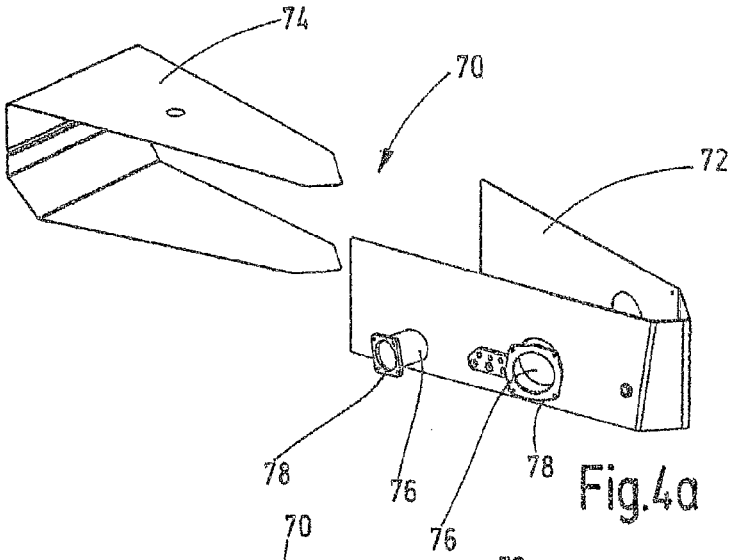
Figure 4B:
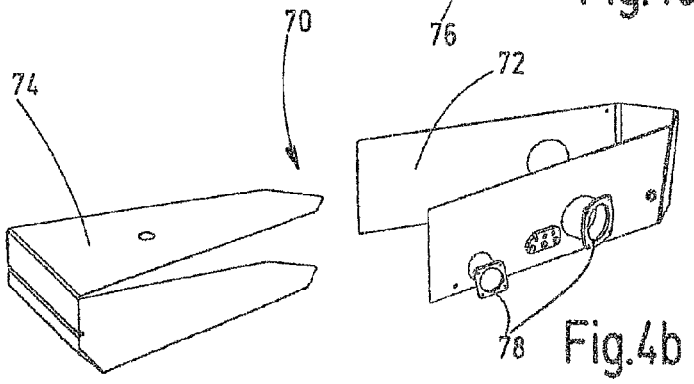
Figure 5A:
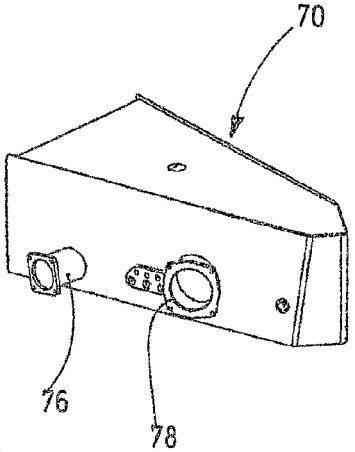
Figure 5B:
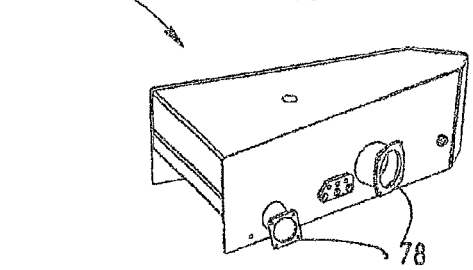

The invention is explained in more detail below with reference to an exemplary embodiment which is illustrated schematically in the drawing, in which FIG. 1 shows a side view of a mobile concrete pump;

FIG. 2 shows a top view of the mobile concrete pump according to FIG. 1 with the distributor mast removed;

FIG. 3*a* shows an exploded illustration of the carrying structure of the concrete pump according to FIGS. 1 and 2 with a premanufactured liquid tank;

FIG. 3*b* shows the carrying structure according to FIG. 3*a* with the liquid tank welded in;

FIGS. 4*a* and *b* show the integral parts of the liquid tank in various diagrammatic exploded illustrations;

FIGS. 5*a* and *b* show the finished premanufactured liquid tank in two different diagrammatic illustrations.

The mobile concrete pump illustrated in FIGS. 1 and 2 has a truck chassis 10, with an engine-driven running gear 12 and with a driver's cab 14, the engine drive of which is couplable to the rear axles 18 via a drive train 16. The truck chassis 10 carries a concrete pump 20 which is connected to the running gear 12 via a mounting frame 22. The concrete pump design essentially comprises a core pump 24 with two hydraulic drive cylinders 26, two conveying cylinders 30 connected in pairs to the drive cylinders 26 via a water box 28 and a material feed container 32 arranged rigidly at the other end of the conveying cylinders 30. The design furthermore comprises a pressure conveying line 34 which is guided via a distributor mast 36, which is in the form of a collapsible mast, and, at the end of the final mast arm, has an end hose (not illustrated) which dispenses the conveyed concrete to the concreting location.

The distributor mast 36 is mounted rotatably about a vertical axis of rotation 48 on a mast trestle 44, which is connected rigidly in the vicinity of the end-side end to a carrying structure 46. In the exemplary embodiment shown, the mast trestle 44 has a shell 52 which is fitted into a polygonal opening 50, which is oriented parallel to the axis of rotation 48 of the distributor mast 36, in the carrying structure 46, is equipped as a rotary bearing for the distributor mast 36 and has a polygonal contour adapted to the polygonal opening 50.

Furthermore, a supporting device 38 with extendable supporting legs 40, 66 is provided. The supporting device 38 here comprises two telescopic tubes 54, 56 which are integrated in the carrying structure, are open diagonally forward and intersect each other at different heights, wherein, below the upper telescopic tube 54 and above the lower telescopic tube 56, the carrying structure 46 has a respective clearance 60, 62 which is separated from the adjacent telescopic tube by an intermediate floor 58. In addition, two rear supporting legs 66 which are pivotable outward laterally are articulated at the joints 64 at the rear end of the carrying structure 46. In the concreting mode, the supporting legs 40, 66 are extended and, with the running gear 12 raised, are supported on the ground.

The hydraulic drive of the core pump 24, the distributor mast 36 and the supporting legs 40, 66 takes place via a drive assembly 42 which comprises a plurality of hydraulic pumps 68 drivable via the drive train 16 originating from the vehicle engine. In order to supply the hydraulic units of the drive assembly 42, a sufficient supply of hydraulic oil is required, for which purpose a liquid tank 70 of appropriate size is required.

A particular feature of the invention consists in that, in the ready mounted state of the concrete pump, the liquid tank 70 is integrated in the carrying structure 46. Since the liquid tank 70 has to be subjected to a reliable leak test before being commissioned, a further particular feature of the invention consists in that the liquid tank 70 together with a suitable connecting structure is premanufactured separately from the rest of the carrying structure 46 and is leak-tested before said liquid tank is subsequently fitted and welded as a load-bearing component into the carrying structure 46. As can be seen from FIGS. 3*a* and *b*, the liquid tank 70 is designed as a component which is adapted geometrically in the outer contour thereof to the carrying structure 46 and supplements and reinforces the carrying structure 46. For this purpose, the premanufactured liquid tank 70 has an integral side wall section 72 and an integral floor, rear wall and ceiling section 74 which is welded thereto, said sections both being designed as bent sheet-metal parts. Furthermore, a plurality of openings 76 which are intended for the attaching of a connecting pipe 78, a coupling sleeve or a window are located in the side wall section 72. It can be seen from FIG. 3*a* that the carrying structure 46 has a ceiling plate 80 which bounds the relevant clearance 60 and is arranged at a distance from the intermediate floor 58, and that the liquid tank 70 is welded to the adjacent telescopic tube 54, 56 and to the ceiling plate 80. The side walls 72 of the liquid tank 70 therefore form load-bearing walls within the carrying structure 46. The effect achieved by said measures is that the liquid tank 70 which, because of the premanufacturing, is relatively small in comparison to the entire carrying structure 46 is handlable in a simple manner and therefore can easily be subjected to a leak test. The repair of leaks can also easily be carried out because of the easy accessibility of the liquid tank 70. Since parts of the liquid tank 70 are used as reinforcing elements of the carrying structure 46, the advantages of the integral tank, with the exception of the double floor and ceiling plates, are maintained.

In summary, the following should be stated: the invention relates to a mobile concrete pump with a carrying structure 46 which is capable of being placed directly or indirectly via a mounting frame 22 onto a running gear 12 of a truck chassis 10, for the accommodation of functional units forming a supporting device 38 and a distributor mast 36. The distributor mast 36 is mounted rotatably on a mast trestle 44, which is integrated in the carrying structure 46, while the supporting device 38 comprises two telescopic tubes 54, 56 which are integrated in the carrying structure 46, are open diagonally forward and intersect each other at different heights. Below the upper and above the lower telescopic tube 54, 56, a respective clearance 60, 62 which is separated from the adjacent telescopic tube by an intermediate floor 58 is located in the carrying structure 46. A particular feature of the invention consists in that a premanufactured liquid tank 70 which is adapted geometrically in the outer contour thereof to the carrying structure 46 and supplements and reinforces the carrying structure 46 is fitted into at least one of the clearances 60.

LIST OF REFERENCE NUMBERS

10 Truck chassis
12 Running gear
14 Driver's cab
16 Drive train
18 Rear axle
20 Concrete pump
22 Mounting frame
24 Core pump
26 Drive cylinder
28 Water box
30 Conveying cylinder
32 Material feed container
34 Pressure conveying line
36 Distributor mast
38 Supporting device
40 Supporting legs
42 Drive assembly
44 Mast trestle
46 Carrying structure
48 Axis of rotation
50 Polygonal opening
52 Shell
54 Upper telescopic tube
56 Lower telescopic tube
58 Intermediate floor
60 Clearance
62 Clearance
64 Joints
66 Rear supporting legs
68 Hydraulic pump
70 Liquid tank
72 Side wall section
74 Floor, rear wall and ceiling section
76 Openings
78 Connecting piece
80 Ceiling plate

The invention claimed is:

1. A mobile concrete pump with a carrying structure (46), which is capable of being placed directly or indirectly via a mounting frame (22) onto a running gear (12) of a truck chassis (10), accommodates functional units forming a supporting device (38); a distributor mast (36) is mounted rotatably on a mast trestle (44) integrated in the carrying structure (46); the supporting device (38) comprises two telescopic tubes (54, 56) integrated in the carrying structure (46) and open diagonally forward and intersect each other at different heights; below the upper telescopic tube and above the lower telescopic tube (54, 56), the carrying structure (46) has a respective clearance (60, 62) which is separated from the adjacent telescopic tube by an intermediate floor (58); a liquid tank (70) supplements and reinforces the carrying structure (46), the liquid tank manufactured separately from the carrying structure (46) is leak-tested and adapted geometrically in an outer contour thereof to the carrying structure (46); the liquid tank is fitted into at least one of the structure clearances (60); the carrying structure (46) has a ceiling plate (80) which bounds the at least one of the clearances (60) and is arranged at a distance from the intermediate floor (58); and the liquid tank (70) is welded to one of the adjacent telescopic tubes (54, 56) and to the ceiling plate (80).

2. The concrete pump as claimed in claim 1, wherein the premanufactured liquid tank (70) is welded in the region of the at least one of the clearances (60) into the carrying structure (46).

3. The concrete pump as claimed in claim 1, wherein the liquid tank (70) has side walls (72) designed as load-bearing walls within the carrying structure (46).

4. The concrete pump as claimed in claim 1, wherein the premanufactured liquid tank (70) comprises an integral side wall section (72) and an integral floor, rear wall and ceiling section (74) welded thereto.

5. The concrete pump as claimed in claim 4, wherein the side wall section (72) and the floor, rear wall and ceiling section (74) are bent sheet-metal parts.

6. The concrete pump as claimed in claim 4, wherein the side wall section (72) has at least one opening (76) for the attaching of at least one of a connecting pipe (78), a coupling sleeve, and a window.

* * * * *